United States Patent [19]

Takenaka et al.

[11] Patent Number: 4,831,307

[45] Date of Patent: May 16, 1989

[54] CATHODE RAY TUBE WITH LIGHT REFLECTION FILM

[75] Inventors: Shigeo Takenaka; Takeo Itou, both of Fukaya; Hidemi Matsuda, Oomiya, all of Japan

[73] Assignee: Kabushiki Kaisha Toshiba, Kawasaki, Japan

[21] Appl. No.: 136,942

[22] Filed: Dec. 23, 1987

[30] Foreign Application Priority Data

Dec. 23, 1986 [JP] Japan ..... 61-305204

[51] Int. Cl.[4] ..... H01J 29/28; H01J 29/89

[52] U.S. Cl. ..... 313/478; 313/474; 313/110; 350/248; 358/252

[58] Field of Search ..... 313/466, 474, 478, 479, 313/110; 350/248; 358/252

[56] References Cited

U.S. PATENT DOCUMENTS 2,762,943 9/1956 Mayer ..... 313/466
4,723,091 2/1988 Kawamura et al. ..... 313/478

FOREIGN PATENT DOCUMENTS 12259 1/1979 Japan ..... 313/466
141149 11/1981 Japan ..... 313/466

*Primary Examiner*—Kenneth Wieder
*Attorney, Agent, or Firm*—Cushman, Darby & Cushman

[57] ABSTRACT

In a cathode ray tube, a single layer for prevention of a reflection of light rays is formed on a face plate having a non-spherical outer surface. The thickness of the layer is continuously decreased from the center region toward the peripheral regions of the face plate.

5 Claims, 5 Drawing Sheets

$$\left(\frac{x}{x_{max}}\right)^2=\left(\frac{d}{d_{max}}-1\right)\left\{\eta\frac{d}{d_{max}}-\left(k\cdot\eta-\frac{1}{(k-1)}\right)\right\}$$

CATHODE RAY TUBE WITH LIGHT REFLECTION FILM

BACKGROUND OF THE INVENTION

This invention relates to a cathode ray tube and, more particularly, to a cathode ray tube having a reflection prevention film formed on a face plate.

The cathode ray tube usually has a smooth glass surface as its outer surface. Therefore, ambient light rays incident on the outer surface acting as a mirror surface are reflected so that the image on the face plate can not be seen clearly.

There are two well-known methods for solving such a problem. In one of these methods, the outer surface of the face plate is formed with fine irregularities so that ambient light rays are scattered by these irregularities, as disclosed in Japanese Patent Laid-Open No. 61-29051. In this method, light rays are randomly reflected by the entire screen. Therefore, the screen as a whole is seen rather whitish, and the contrast seems to be deteriorated. Further, the resolution of the image is liable to be deteriorated. In the second method, a reflection prevention film having a single-layer or multiple-layer structure is formed on the outer surface of the face plate for preventing the reflection, as disclosed in Japanese Patent Laid-Open No. 61-91838. The reflection prevention film is usually made of a material having a refractive index lower than the refractive index of the glass material of the face material. The optimum thickness of the film is $\lambda/4n$ where $\lambda$ is the wavelength of light rays, the reflection of which is to be prevented, and n is the refractive index of the film. For example, where a film of magnesium fluoride is formed on the face plate to prevent the reflection of light rays with a wavelength of 0.55 $\mu$m, the thickness of this film is set to 0.1 $\mu$m for the refractive index of magnesium fluoride is substantially 1.38. With the face plate with such a reflection prevention film, the reflection prevention effect is different with the central and peripheral areas. That is, light rays incident on the face plate are seen in different colors in the central and peripheral areas of the face plate, for instance, in purple in the central area and in blue in the peripheral areas of the face plate. This phenomenon is undesired in a cathode ray tube from the standpoint of the color reproducibility.

SUMMARY OF THE INVENTION

An object of the invention is to provide a cathode ray tube, which has a uniform reflection prevention effect substantially over the entire region of the face plate.

The inventors have found that the phenomenon of the center region and peripheral region of the face plate being seen in different colors, is due to the fact that in the center region of the face plate, light rays incident substantially perpendicularly to the face plate are reflected substantially perpendicular by the face plate to enter the eye of the observer, while in the peripheral region of the face plate light rays incident obliquely on the face plate are reflected obliquely to enter the eye of the observer. This means that the light path of light rays proceeding through the reflection prevention film in the center region of the face plate and the light path of light rays proceeding the reflection prevention film in the peripheral region of the film are different. This substantially gives the effect that the thickness of the reflection prevention film is increased for the peripheral region compared to the center region of the face plate.

According to the invention, there is provided a cathode ray tube having a face plate in which a picture image is displayed, which comprises a layer for prevention of the reflection of light rays, the layer being formed on a face plate, the thickness of the layer varying continuously from the center region toward the peripheral regions of the face plate.

DETAILED DESCRIPTION OF THE PREFERRED EMBODIMENT

Figure 1:
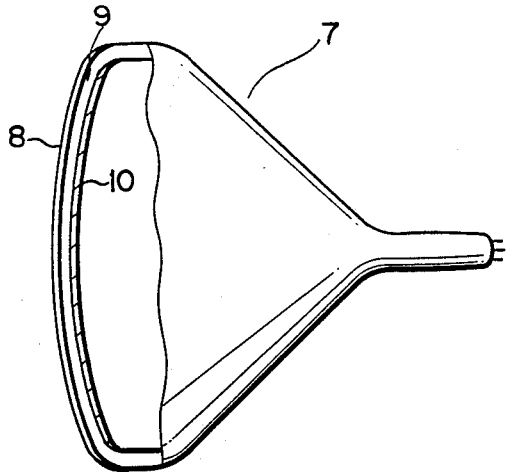
FIG. 1 is a side view, partly broken away, showing one embodiment of the cathode ray tube according to the invention.

FIG. 1 shows a cathode ray tube having envelope 7. On the inner surface of face plate 9 of envelope 7 is formed phosphor layer 10. As is well known in the art, when electron beams generated from an electron gun (not shown) land on phosphor layer 10, light rays are emitted from phosphor layer 10, whereby an image is reproduced on phosphor layer 10. This image is observed by the observer through the face plate.

As shown in FIG. 1, reflection prevention film 8 is formed on the curved outer surface of face plate 9. Reflection prevention film 8 is made of a material having a refractive index lower than 1.52 to 1.54, the refractive index of face plate 9, e.g., magnesium fluoride with a refractive index of approximately 1.38. Reflection prevention film 8 is formed to have such a thickness that the central region of face plate 9 has a greater thickness than the peripheral regions. For example, the thickness of reflection prevention film 8 formed on face plate 9 varies continuously such that face plate 9 has a thickness of 0.22/n $\mu$m in the central region and a thickness of 0.04/n $\mu$m in the peripheral regions.

The reason why the thickness of the reflection prevention film is varied continuously such that the center region of face plate 9 has a greater thickness than the peripheral regions will now be explained.

Figure 2:
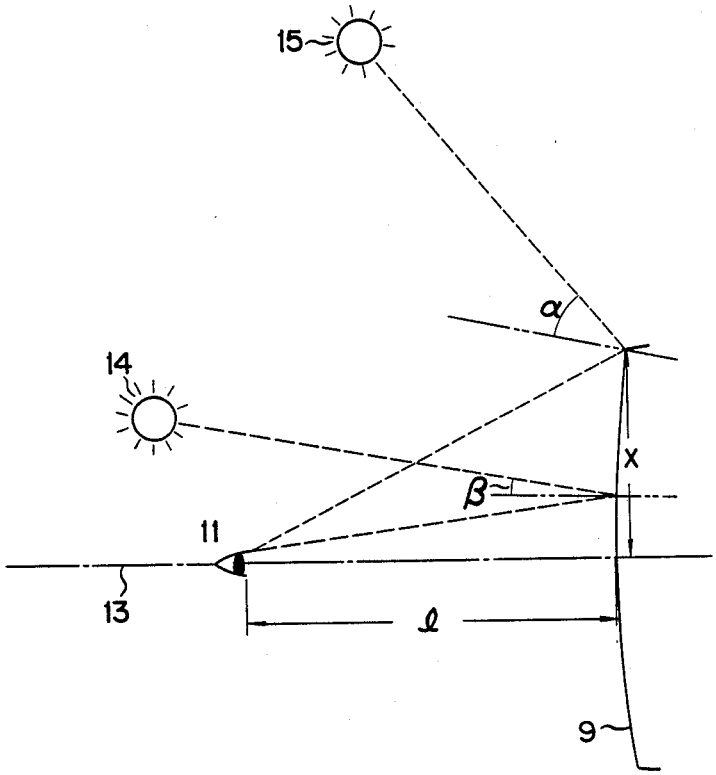
FIGS. 2 and 3 are views showing optical paths of light rays incident on the face plate shown in FIG. 1 and reflected therefrom toward an observer.
Figure 3:
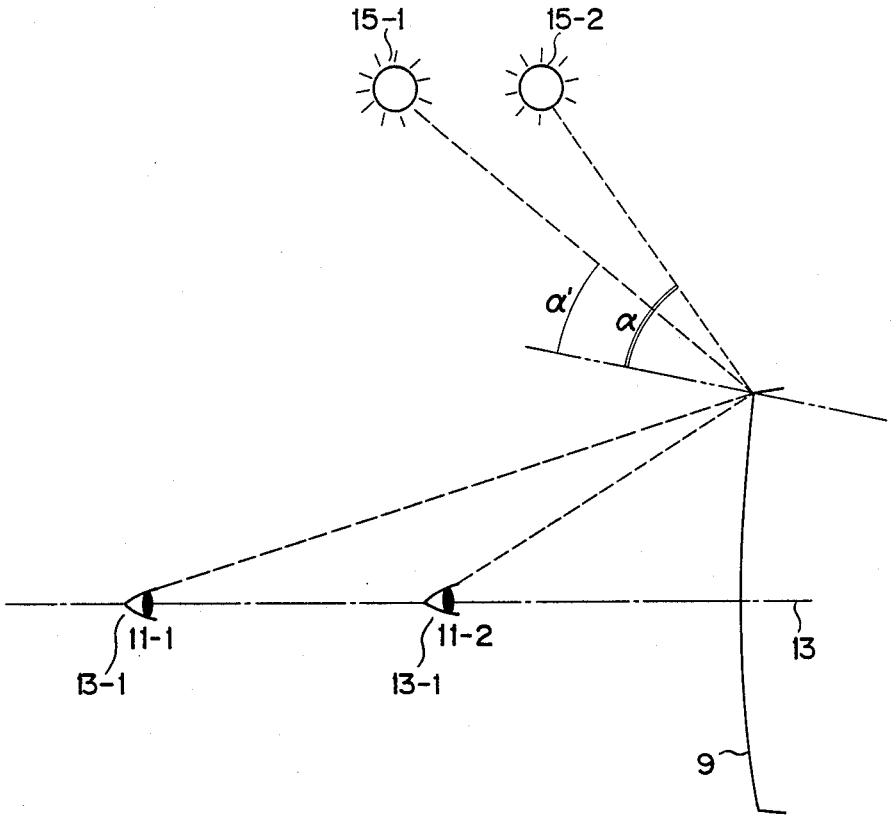

As shown in FIG. 2, the observer usually observes the image on the face plate along axis 13 thereof. The outer surface of face plate 9 has a certain radius of curvature and has a shape nearly that of a convex mirror surface, as is well known in the art. Therefore incidence angle $\alpha$ of light rays from light source 15 and reflected by the peripheral region of face plate is greater than incidence angle $\beta$ of light rays from light source 14 and reflected by the center region. The incidence angle $\alpha$ varies depending on the radius of curvature of face plate 9. However, the incidence angle $\alpha$ is increased with reducing radius of curvature of face plate 9. The distance l between face plate 9 and observer 11 varies depending on the use of the cathode ray tube. With the ordinary television set, however, the distance l is about 3.3 m, while it is about 0.4 m in case of a display of a computer or the like. Such difference in the distance noted above depending on different uses, is a factor in varying the value of the incidence angle $\alpha$. More specifically, for observers 13-1 and 13-2 who are at different positions as shown in FIG. 3, the distances from face 0 plate 9 are different, so that incidence angles $\alpha$ and $\alpha'$ of light rays from different light sources 15-1 and 15-2 are different. Generally, the incidence angles $\alpha$ and $\alpha'$ are reduced with increasing distance l.

Figure 4:
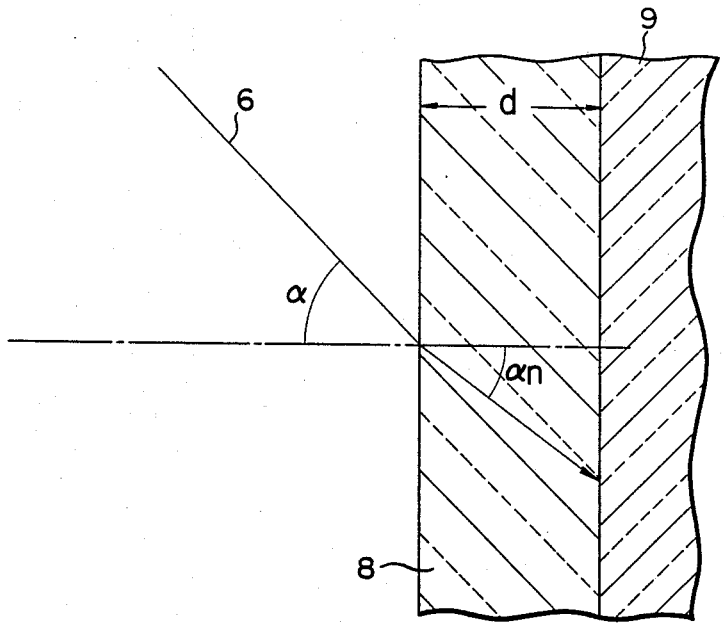
FIG. 4 is a view showing an optical path of light rays refracted by the reflection prevention film shown in FIG. 1.

The thickness d of reflection prevention film 8 is given as $nd=\lambda/4$ where n is the refractive index of the film material and $\lambda$ is the wavelength of light rays, the incidence of which is to be prevented. This condition is satisfied when the incidence angle is 0, i.e., when light rays are incident perpendicularly on the face plate. When the incidence angle is $\alpha$, light rays are incident on the reflection prevention film with incidence angle $\alpha$ as shown in FIG. 4 to be refracted at the surface with refraction angle $\alpha n$. Therefore, the substantial film thickness with respect to light rays having incidence angle $\alpha$ is given as $d/\cos \alpha n$.

According to the invention, under the assumption that observer 11 is on axis 13 of face plate 9, the thickness of reflection prevention film is determined in correspondence to the incidence angle $\alpha$ of light rays. The value of d is ideally $\lambda/4n \cos \lambda n$ (where $n=\sin \alpha/\sin \alpha n$). The incident angle $\alpha$ of ambient light rays is increased as one goes from the center region toward the peripheral region of the face plate. Therefore, the thickness of the reflection prevention film is reduced as one goes toward the peripheral region. However, the difference in the thickness of the reflection prevention film between the center region and peripheral region has to be determined by taking the use and kind of the cathode ray tube into considerations because the incidence angle $\alpha$ varies with the radius of curvature of the face plate and the distance between the face plate and observer as noted above. If light rays with a maximum visible range wavelength of 0.7 $\mu$m is to be prevented when the incidence angle of ambient rays is 0, the thickness of the reflection prevention film should be 0.17/n to 0.22/n $\mu$m. If the reflection of light rays with a minimum visible range wavelength of 0.35 $\mu$m is to be prevented when the incidence angle of ambient light rays is 60°, the thickness should be about 0.04/n. Hence the thickness of the reflection prevention film should range from 0.04/n to 0.22/n $\mu$m.

Figure 5:
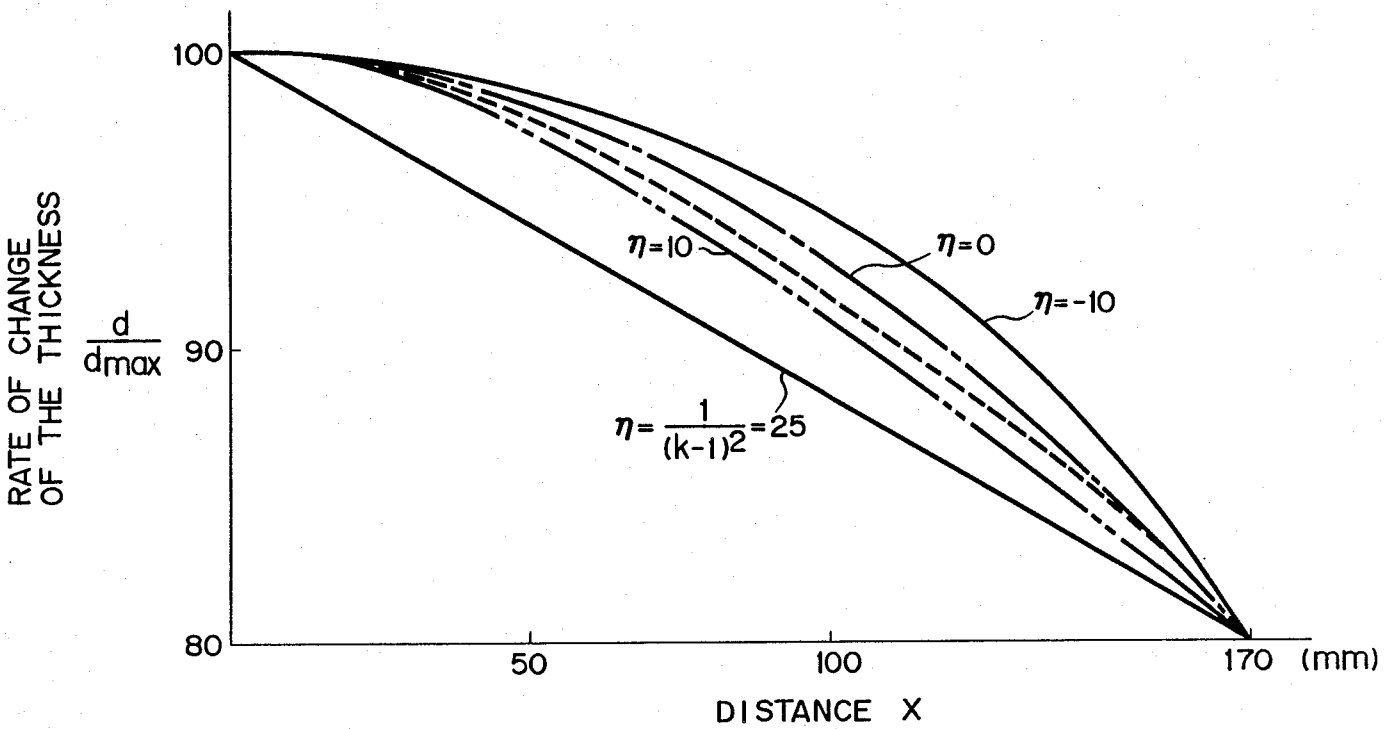
FIG. 5 is a graph showing a function of the thickness of the reflection prevention film, i.e., changes in the rate of change d/dmax in the thickness of the film with the distance l from the center of the face plate with a parameter about the rate of change in the film thickness as a variable.

The thickness of reflection prevention film 8 can be suitably defined by a formula expressing the rate of change d/dmax of the thickness, as shown in FIG. 5.

$$\left(\frac{X}{X\max}\right)^2 = \left(\frac{d}{d\max} - 1\right)\left(\eta \cdot \frac{d}{d\max} - \left(k\eta - \frac{1}{k-1}\right)\right) \quad (1)$$

where X is a distance from the center point of the face plate, d is the film thickness, dmax is the maximum value of film thickness, k is the value of d/dmax in X=Xmax, and $\eta$ is a constant concerning the rate of change in the film thickness. These parameters k are determined by the type and use of the cathode ray tube and the material of the thin film. When the radius of curvature of the cathode ray tube is small or when the observer sees the cathode ray tube at a position comparatively close to the face plate, the value of k is set to be small. In the opposite cases, the value of k is set to be large. The value of k is required to be the smaller than the refractive index of the material of the reflection prevention film. Further, the solution of the equation 1 is selected such that d/dmax reduces with increasing X. When d/dmax is selected in this way, when $1/(k-1)^2>\eta$, the rate of decrease of d/dmax as one goes toward the periphery of the face plate, i.e., as the distance X approaches Xmax. At this time, by setting the thickness of the center region of the face plate to be $\lambda/4n$, the ideal film thickness can be obtained over the entire surface of the face plate.

The equation 1 is provided on the basis of the above considerations. More particularly, face plate 9 has a non-spherical curved outer surface with varying radius of curvature. For the sake of the simplicity, however, it is assumed that the outer surface of face plate 9 is part of a spherical surface with radius R. Denoting the distance from eye 11 of the observer to face plate 9 as shown in FIG. 2 by l and the incidence angle of light rays incident on a region at a distance X from the center of face plate 9 and directed toward eye 11 of the observer by $\alpha$, this incidence angle $\alpha$ is given as $$\alpha = 2\pi - \tan^{-1}\frac{l + R - \sqrt{R^2 - X^2}}{X} - \tan^{-1}\frac{\sqrt{R^2 - X^2}}{X} \quad (2)$$

Therefore, the refractive angle $\alpha n$ is given from the Snell's raw as $$\alpha n = \sin^{-1}\frac{\sin \alpha}{n} = \sin^{-1}\frac{\sin\left(2\pi - \tan^{-1}\frac{l + R - \sqrt{R^2 - X^2}}{X} - \tan^{-1}\frac{\sqrt{R^2 - X^2}}{X}\right)}{n} \quad (3)$$

Therefore, denoting the film thickness as d, the length of light path from the incidence surface of the film to the surface of face plate 9 is given as $d \cos \alpha n$. Since the length of the light path may be made equal to the ideal value $\lambda/4n$ of reflection prevention film 8, the ideal thickness of the reflection prevention film in the peripheral region of face plate 9 is given as a function of X as $$d = \frac{\lambda}{4n} \cdot \cos an = \frac{\lambda}{4n} \cdot \cos \left\{ \sin^{-1} \frac{\sin\left(2\pi - \tan^{-1} \frac{l + R - \sqrt{R^2 - X^2}}{X} - \tan^{-1} \frac{\sqrt{R^2 - X^2}}{X}\right)}{n} \right\} \quad (4)$$

The equation 1 is obtained from the equation (4), wherein the radius of curvature R and the distance l are expressed by the parameters $\eta$, k and x. The equation 1 can be applied to the reflection prevention film formed on the face plate which has not only the spherical curved outer surface but also the non-spherical curved outer surface. In the face plate having the non-spherical curved surface, the radius of curvature R is varied depending on the distance X and is expressed by a function of X. The non-spherical curved outer surface may be defined by a single radius of curvature or a compound radius of curvature.

EXAMPLE 1

A deposition film of magnesium fluoride was formed as reflection prevention film on face plate 9 of a 14-inch type color cathode ray tube. In order to prevent reflection of light rays in the neighborhood of $\lambda = 550$ nm, the reflection prevention film was formed such that the thickness of its center was 0.1 $\mu$m and the thickness of its outermost portion X (in case of 14-inch type color cathode ray tube) was .0.08 $\mu$m, i.e., 8 times the thickness of the center. The rate of change in the thickness of the peripheral region at this time, was varied to determine the thickness of face plate 9.

Figure 6:
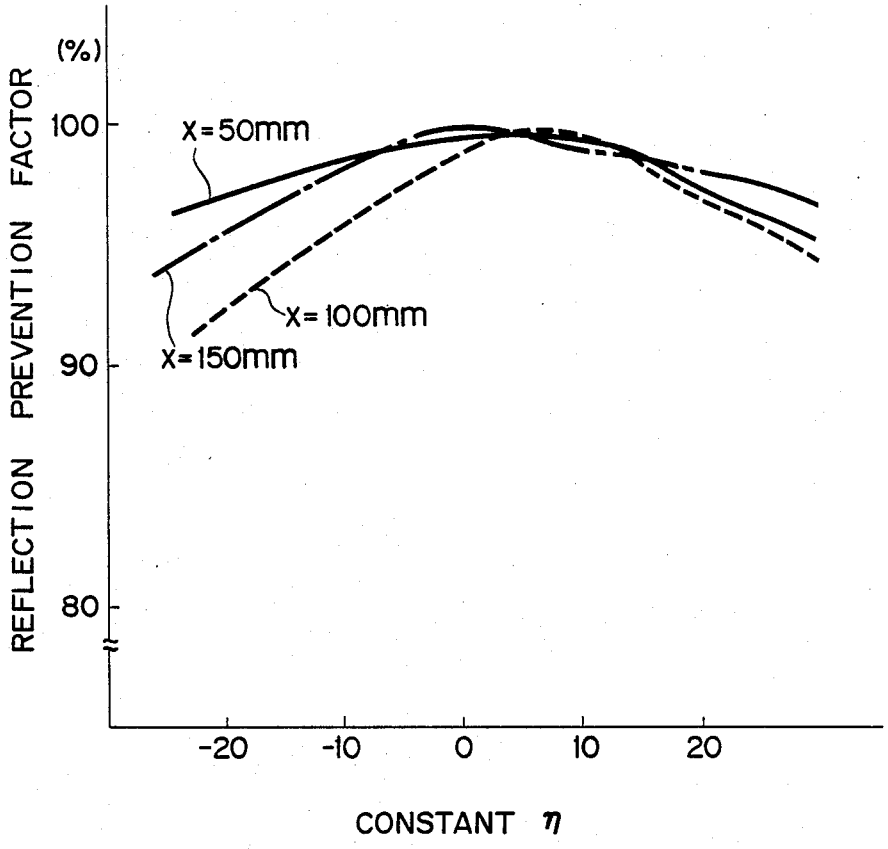
FIG. 6 is a graph showing the relation between a parameter of the rate of change in the film thickness and reflection prevention factor.

FIG. 6 shows the relation between the constant $\eta$ concerning the rate of change in the film thickness at points at distance X of 50, 100 and 150 mm from the center of the face plate and reflection prevention factor in the neighborhood of 550 nm when the distance l between the observer and face plate was 30 cm. From the relation shown in FIG. 6, it was confirmed that the reduction of the reflection prevention factor could be suppressed at points at distances of 50, 100 and 150 mm when $\eta$ is $-10 < \eta < 1/(k-1)^2$. When the color cathode ray tube of this example was observed from a point on the face plate axis at a distance of 0.4 m from the face plate surface, the reflection of white light rays was purple over the entire region of the face plate. When the cathode ray tube was observed from a point on the face plate axis at a distance of 1 m or above from the face plate, the reflection of white light rays in the peripheral region has rather reddish color compared to the purple color. When the thickness of the reflection prevention film was uniformly set to 0.1 $\mu$m, by observing the cathode ray tube at a distance of 4 m or above from the face plate surface, the reflected light rays were purple as a whole, the peripheral region becomes reddish as one goes toward the face plate surface. At a distance of approximately 0.4 m, russet light rays were seen.

EXAMPLE 2

A $SiO_2$ film was formed as reflection prevention film on the face plate surface of a 26-inch type color cathode ray tube as shown in FIG. 1. The $SiO_2$ film was formed by coating and sintering a blend solution composed of silicon alcolate, water, alcohol and acid. The $SiO_2$ film was formed to have a thickness of 0.1 $\mu$m in the center region and 0.08 to 0.07 $\mu$m in the peripheral regions. In this case, the same effects as in Example 1 could be obtained. By forming the film in this way, satisfactory ambient light reflection prevention effect could be obtained over the entire screen surface.

While the above description of the invention has been concerned the reflection prevention film made of magnesium fluoride, this is by no means limitative. For example, by forming the reflection prevention film of a material having a lower refractive index than the face plate, sufficient reflection prevention effect can be obtained. Further, it is obviously possible to use a spin control method in lieu of the deposition method for forming the reflection prevention film.

As has been described in the foregoing, according to the invention it is possible to prevent the phenomenon that the reflection prevention effect varies on the face plate according to the difference in the incidence angle of ambient light rays and readily obtain a cathode ray tube having uniform reflection prevention effect.

What is claimed is:

1. A cathode ray tube having a face plate having a non-spherical curved surface in which a picture image is displayed, comprising:

a layer for the prevention of the reflection of light rays, said layer being formed on the surface of the face plate, the thickness of said layer continuously decreasing from the center region toward the peripheral regions of said face plate, at a rate of change (d/max) given as:

$$(X/Xmax)^2 = (d/dmax - 1)\{\eta \cdot d/dmax - (k\eta - 1/k - 1)\}$$

where X is a distance from the center point of the faceplate, d is the thickness of the layer, dmax is the maximum value of the layer thickness, k is the value of d/max for X=Xmax, and $\eta$ is a constant concerning the rate of change in the thickness of the layer and satisfies the inequality $(1/(k-1)^2 > \eta)$.

2. The cathode ray tube according to claim 1, wherein said layer is made of a material having a refractive index (n) lower than the refractive index of said face plate, and the thickness of said layer ranges from 0.22/n to 0.04/n $\mu$m.

3. The cathode ray tube according to claim 1, wherein said non-spherical curved surface is defined by a compound radius of curvature.

4. The cathode ray tube according to claim 1, wherein said layer is made of magnesium fluoride.

5. The cathode ray tube according to claim 1, wherein said layer is a single-layered structure.

* * * * *